US009222279B2

(12) United States Patent
Hayter et al.

(10) Patent No.: US 9,222,279 B2
(45) Date of Patent: Dec. 29, 2015

(54) FENCING PANEL

(75) Inventors: Darren Hayter, Trigg (AU); Edward Joseph Khoury, Bateman (AU)

(73) Assignee: U-CLIK BARRIERS PTY LTD, Trigg (AU)

( * ) Notice: Subject to any disclaimer, the term of this patent is extended or adjusted under 35 U.S.C. 154(b) by 191 days.

(21) Appl. No.: 13/992,658

(22) PCT Filed: Dec. 9, 2011

(86) PCT No.: PCT/AU2011/001590

§ 371 (c)(1),
(2), (4) Date: Jun. 7, 2013

(87) PCT Pub. No.: WO2012/075535

PCT Pub. Date: Jun. 14, 2012

(65) Prior Publication Data

US 2013/0256618 A1 Oct. 3, 2013

(30) Foreign Application Priority Data

Dec. 10, 2010 (AU) ..... 2010905421

(51) Int. Cl.
*E04H 17/14* (2006.01)

(52) U.S. Cl.
CPC ..... *E04H 17/14* (2013.01); *E04H 17/1413* (2013.01); *E04H 17/1421* (2013.01); *E04H 2017/1465* (2013.01); *E04H 2017/1482* (2013.01)

(58) Field of Classification Search
None
See application file for complete search history.

(56) References Cited

U.S. PATENT DOCUMENTS

| | | | | | |
|---|---|---|---|---|---|
| 3,434,748 | A * | 3/1969 | Ghislain | 403/257 |
| 3,698,144 | A * | 10/1972 | Stratton | 52/99 |
| 3,837,625 | A * | 9/1974 | Loov | 254/104 |
| 4,077,730 | A * | 3/1978 | Zaidan | 403/385 |
| 5,882,001 | A | 3/1999 | Reinbold | |
| 6,375,166 | B1 * | 4/2002 | Schall et al. | 256/65.08 |
| 7,152,849 | B2 * | 12/2006 | Graber | 256/22 |
| 2003/0175070 | A1 * | 9/2003 | Booysen et al. | 403/231 |
| 2008/0029747 | A1 * | 2/2008 | Lehmann | 256/65.01 |
| 2010/0264388 | A1 * | 10/2010 | Duffy et al. | 256/22 |

FOREIGN PATENT DOCUMENTS

CN 201351378 11/2009

OTHER PUBLICATIONS

International Search Report for PCT/AU2011/001590; date of mailing Feb. 20, 2012.

(Continued)

*Primary Examiner* — Michael P Ferguson
*Assistant Examiner* — Matthieu Setliff
(74) *Attorney, Agent, or Firm* — Tope-McKay & Associates

(57) ABSTRACT

A fencing panel includes a rail having openings in a first side to receive elongate members. A longitudinal channel is provided along a second side of the first rail, the second side being perpendicular to the first side. A set of second openings are provided within the longitudinal channel, each of the second openings corresponding to one of the first openings. Wedge members are inserted into each of the second openings such that the wedge members engage with the first rail, and an elongate member is inserted into the corresponding first opening such that the elongate member is secured to the first rail. A side cover plate is securable across the longitudinal channel.

14 Claims, 10 Drawing Sheets

(56) References Cited

OTHER PUBLICATIONS

International Written Opinion of the International Searching Authority for PCT/AU2011/001590; date of mailing Feb. 20, 2012.

Response to the International Written Opinion of the International Searching Authority for PCT/AU2011/001590; dated Oct. 5, 2012.

International Preliminary Report on Patentability (Chapter II of the Patent Cooperation Treaty) for PCT/AU2011/001590; date of mailing Oct. 24, 2012.

* cited by examiner

DETAIL C

FENCING PANEL

BACKGROUND OF THE INVENTION (1) Field of Invention

The present invention relates to a fencing panel and, more particularly, to a fencing panel that is easy to install, creates a secure connection, and does not detract from the appearance of the panel.

(2) Description of Related Art

A common construction of a fencing panel comprises a pair of parallel rails having a plurality of elongate members extending between the rails at regular intervals. The elongate members extending between the rails may be spaced apart to provide an open panel, such as may be used for balustrading or a pool fence, or may be closely spaced so that the fence panel forms a structure such as a privacy screen.

The elongate members interconnecting the rails are often inserted into openings provided along a side of each of the rails. In many applications, the elongate members must be connected to the rails in a manner to withstand forces tending to pull the elongate members away from the rails. For example, in pool fencing or balustrading, the lower rail must be securely connected to the elongate members so that a person standing on the lower rail will not pull the rail free.

In one version of known panels, the elongate members may be simply secured by a suitable threaded fastener. Other methods of connecting the elongate members to the rails have been proposed, including methods where clip type devices are inserted through the same aperture in the rail as the elongate member. The inserted devices are provided to engage the elongate member and secure it relative to the rail. These types of systems, however, can detract from the appearance of the panel due to the clip devices being visible.

Thus, a continuing need exists for a fence panel having elongate members secured to rails in a manner that is easy to install, creates a secure connection, and does not detract from the appearance of the panel.

SUMMARY OF THE INVENTION

The present invention relates to a fencing panel and, more particularly, to a fencing panel that is easy to install, creates a secure connection, and does not detract from the appearance of the panel. The fencing panel comprises a first rail; a plurality of first openings in a first side of the first rail; a plurality of elongate members provided such that a first end of each of the elongate members is received in one of the first openings; a longitudinal channel provided along a second side of the first rail, the second side being perpendicular to the first side; a plurality of second openings provided within the longitudinal channel, each of the second openings corresponding to one of the first openings; a plurality of wedge members; and a side cover plate securable across the longitudinal channel. One of the wedge members is inserted into each of the second openings such that the wedge member engages with the first rail and the elongate member inserted into the corresponding first opening, such that the elongate member is secured to the first rail.

In another aspect, the first rail comprises a longitudinal channel on a third side thereof having a corresponding side cover plate, the third side being opposite and parallel to the second side.

In another aspect, the first rail comprises a pair of parallel side walls interconnected by a pair of inner walls such that the longitudinal channels are defined along the second and third sides of the first rail.

In another aspect, each of the inner walls comprises a recessed portion along the length thereof, the distance between the recessed portions of each inner wall being less than the width of the elongate members and the second openings being formed by cut away sections of the recessed portions.

In another aspect, the recessed portions are generally of rectangular transverse cross section and are located centrally on the inner walls.

In another aspect, each wedge member is to be inserted into one of the second openings between the elongate member and an edge of the second opening such that a first side thereof engages with the elongate member and the second side engages with the edge of the second opening.

In another aspect, the wedge member comprises a relatively thin first end and a relatively thick second end such that the first end is to be inserted into the second opening first, such that as the wedge member is pushed into the second opening, the wedge member is wedged between the elongate member and the edge of the second opening.

In another aspect, the first side of the wedge member comprises a plurality of ribs extending perpendicularly to the direction of travel of the wedge member as it is inserted into the second opening such that the ribs engage and grip against the side of the elongate member.

In another aspect, the wedge member comprises triangular serrations on a second side thereof to engage against the edge of the second opening as the wedge member is pressed into place.

In another aspect, the wedge member comprises a relatively planar body having a transverse edge portion adjacent the second end thereof and tapered edge portions along opposed edges of the planar body extending from the first end to the second end, the tapered edge portions including the triangular serrations.

In another aspect, the longitudinal channels are provided with lip portions adjacent the outer edges thereof such that a tool comprising a shaft having an outwardly extending arm portion may be engaged with the lip portion and pivoted to engage the wedge member and push the wedge member into place.

In another aspect, the lip portions define longitudinal slots along the edges of the side walls to receive complementary shaped ribs provided on the side cover plates.

In another aspect, there is provided a second rail having a plurality of openings on a first side thereof to receive second ends of the elongate members.

In another aspect, the first and second rails are connected at first ends thereof to a first post member and at second ends thereof to a second post member.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
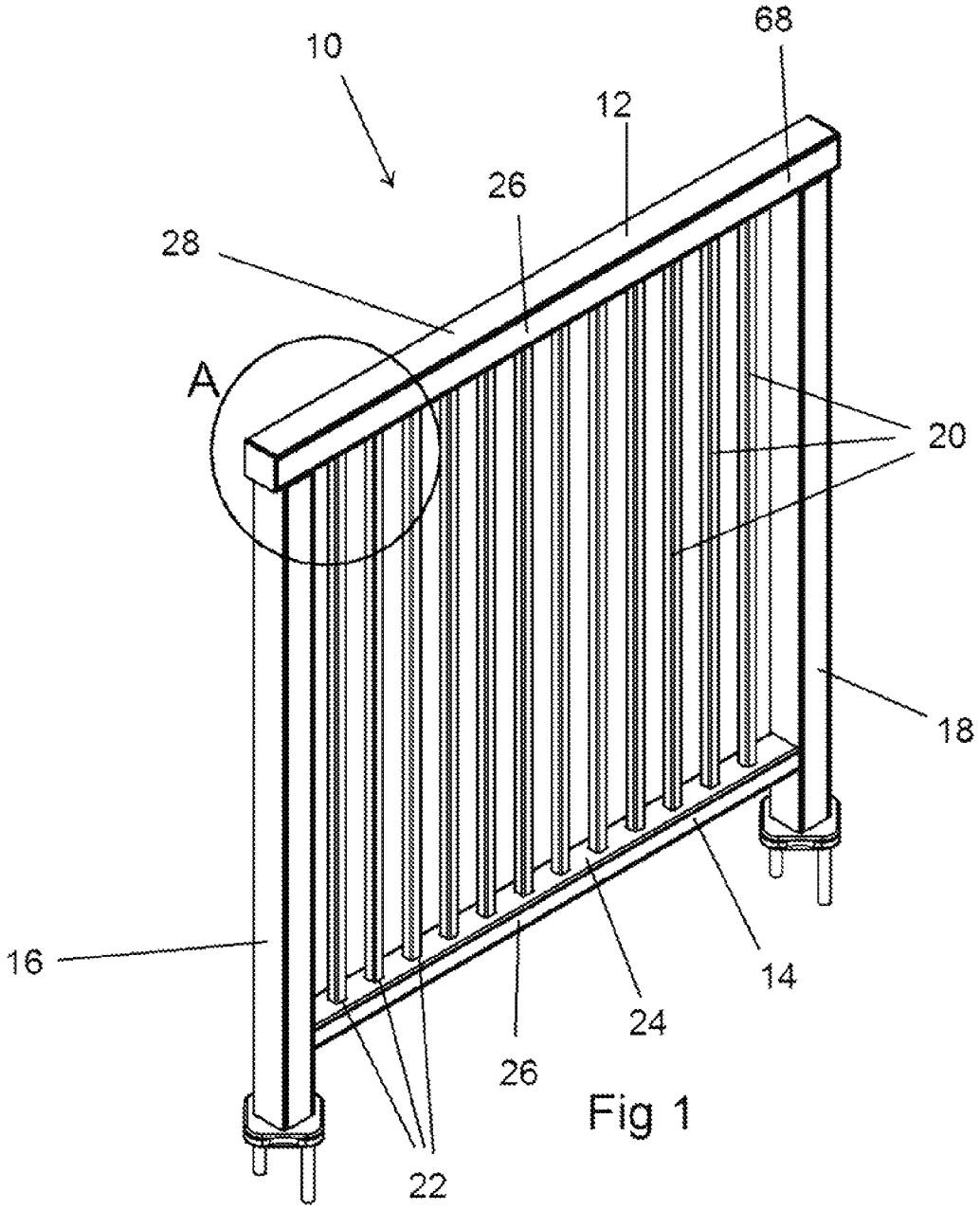
FIG. 1 is a top, perspective-view illustration of a fencing panel according to principles of the present invention.

The present invention relates to a fencing panel and, more particularly, to a fencing panel that is easy to install, creates a secure connection, and does not detract from the appearance of the panel. The following description is presented to enable one of ordinary skill in the art to make and use the invention and to incorporate it in the context of particular applications. Various modifications, as well as a variety of uses, in different applications will be readily apparent to those skilled in the art, and the general principles defined herein may be applied to a wide range of embodiments. Thus, the present invention is not intended to be limited to the embodiments presented, but is to be accorded with the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter-clockwise have been used for convenience purposes only and are not intended to imply any particular fixed direction. Instead, they are used to reflect relative locations and/or directions between various portions of an object. As such, as the present invention is changed, the above labels may change their orientation.

(1) Specific Details

Referring to the figures, there is shown a fencing panel 10 in accordance with the present invention. The fencing panel 10 comprises a first rail 12 and a second rail 14 oriented parallel to the first rail 12. The first and second rails 12 and 14 are connected at first ends thereof to a first post member 16 and at second ends thereof to a second post member 18.

The fencing panel 10 includes a plurality of elongate members 20 each extending between the first rail 12 and the second rail 14. A plurality of first openings 22 are provided in a first side 24 of the first rail 12 and a plurality of first openings 22 are provided in a first side 24 of the second rail 14. The first side 24 of the first rail 12 is the side adjacent the second rail 14, and the first side 24 of the second rail 14 is the side adjacent the first rail 12. First ends of the elongate members 20 are each received in one of the first openings 22 in the first rail 12 and second ends of the each of the elongate members 20 are received in one of the first openings 22 in the second rail 14. In the embodiment shown, the first openings 22 in the first and second rails 12 and 14 are provided at regular intervals along the length of the rails 12 and 14 such that the elongate member 20 are located at regular intervals along the length of the fencing panel 10.

Figure 2A:
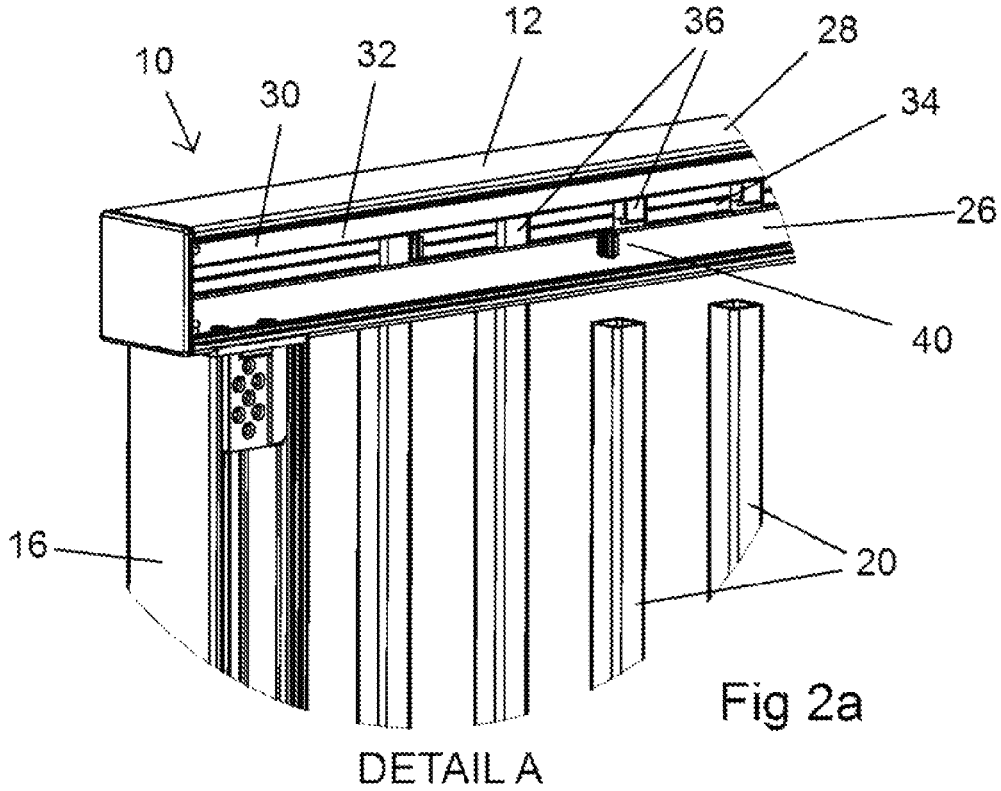
FIG. 2*a* is a perspective-view illustration of Detail A of FIG. 1 with the side cover plates of the rails removed according to principles of the present invention.
Figure 2B:
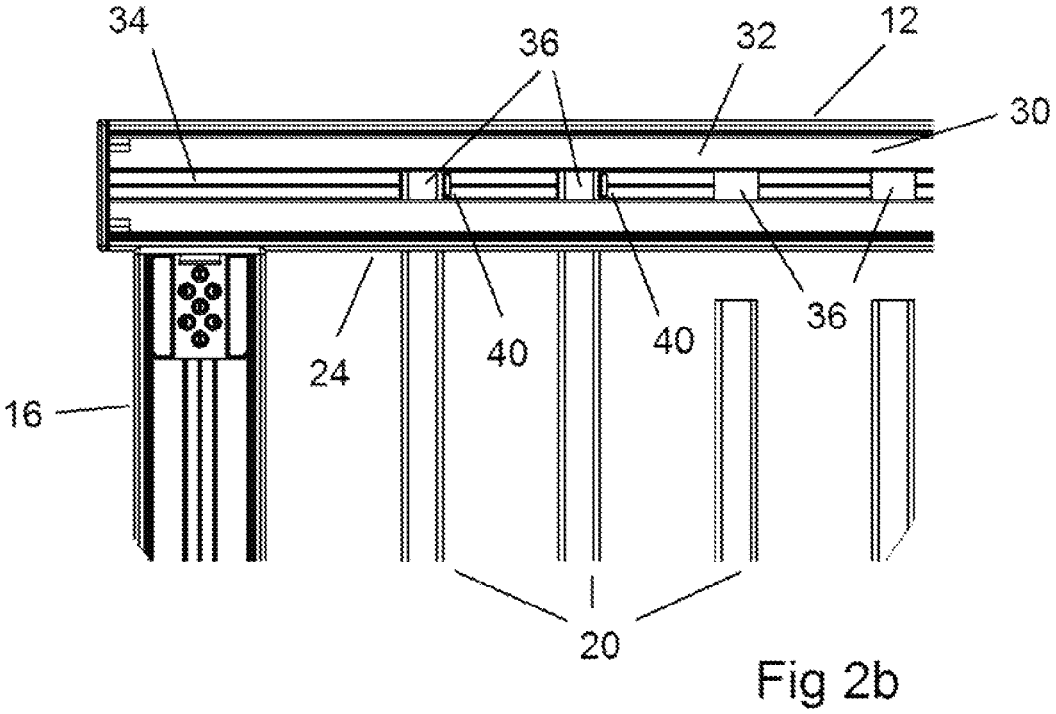
FIG. 2*b* is a front-view illustration of Detail A of FIG. 1 according to principles of the present invention.
Figure 3:
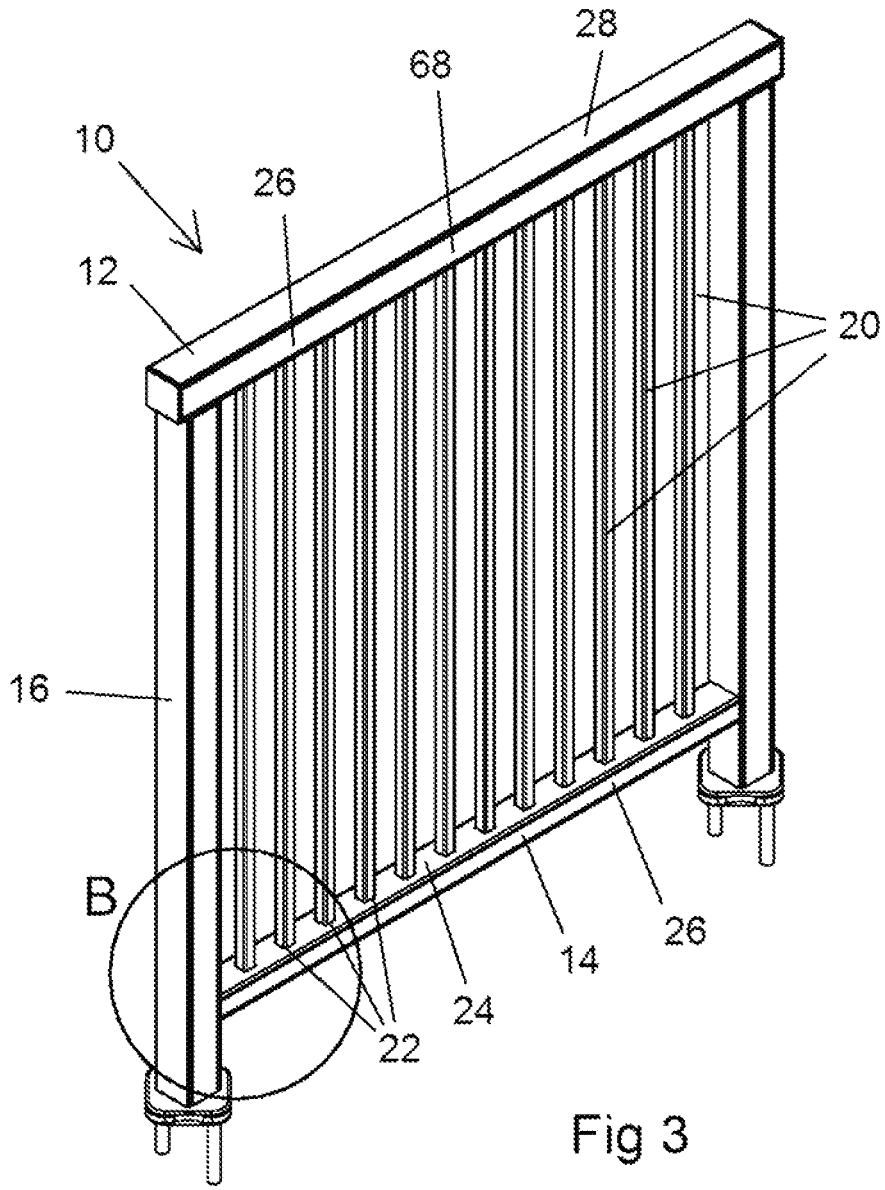
FIG. 3 is a top, perspective-view illustration of a fencing panel according to principles of the present invention.
Figure 4A:
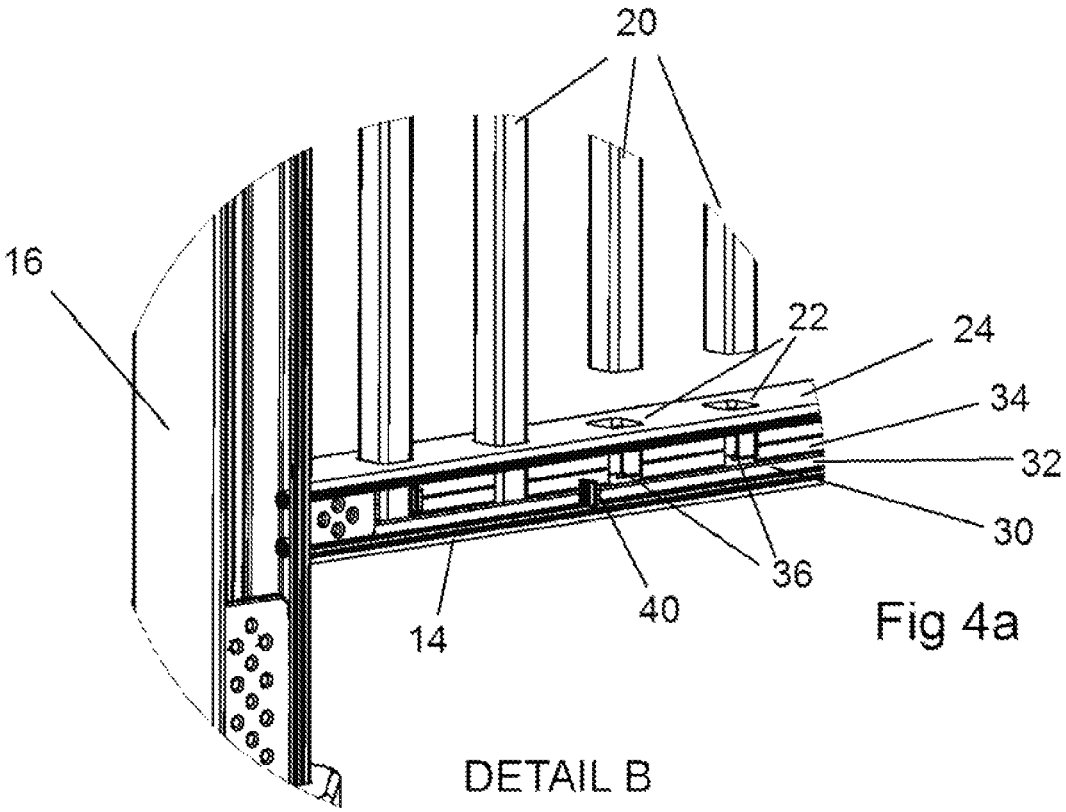
FIG. 4*a* is a perspective-view illustration of Detail B of FIG. 3 with the side cover plates of the rails removed according to principles of the present invention.
Figure 4B:
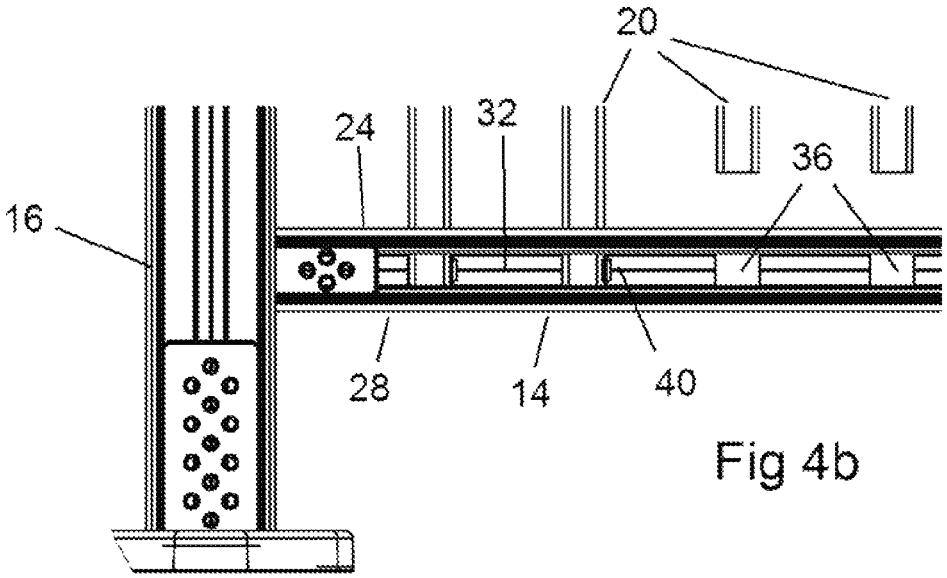
FIG. 4*b* is a front-view illustration of Detail B of FIG. 3 according to principles of the present invention.
Figure 5:
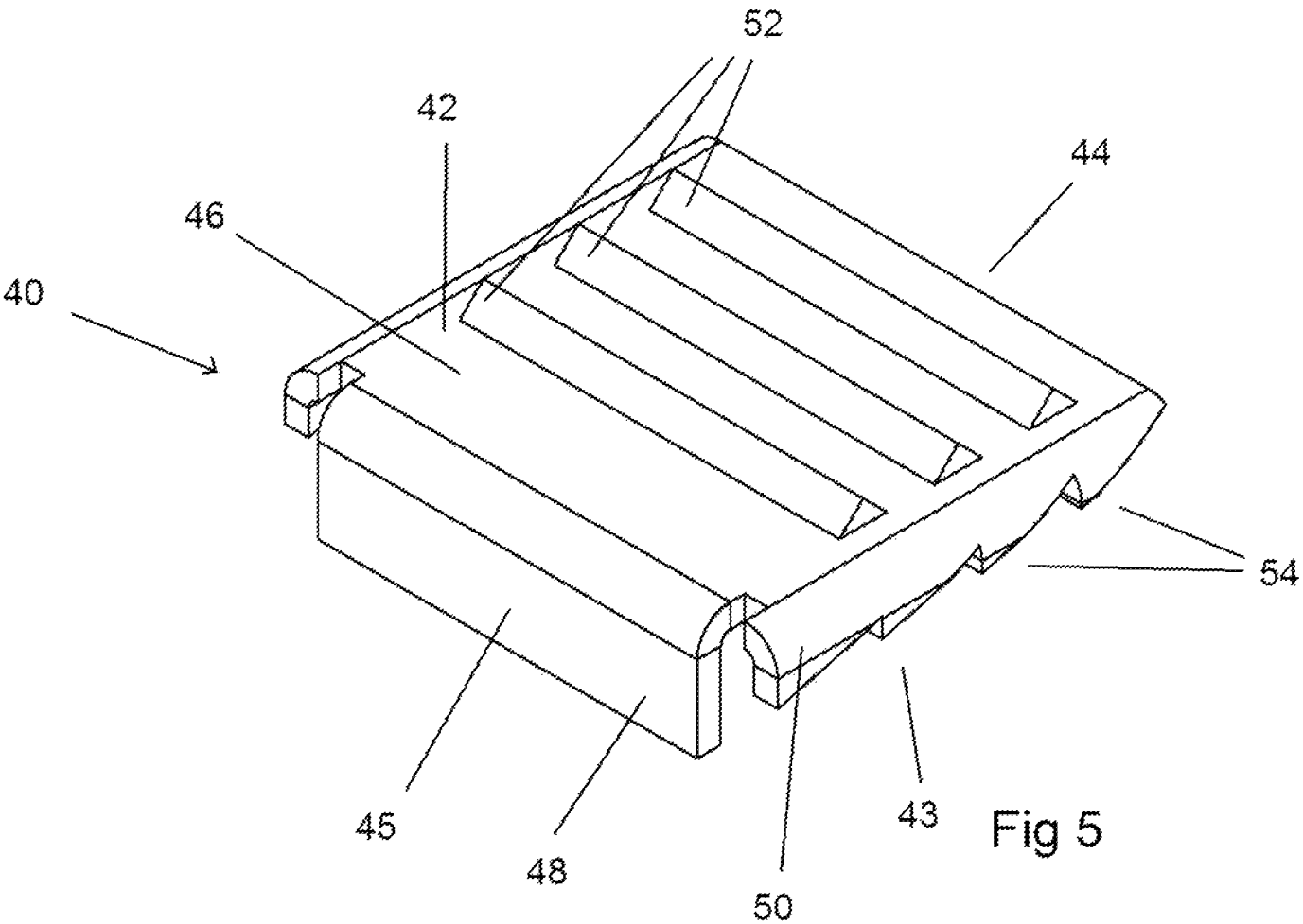
FIG. 5 is a perspective-view illustration of one of the wedge members according to principles of the present invention.
Figure 6:
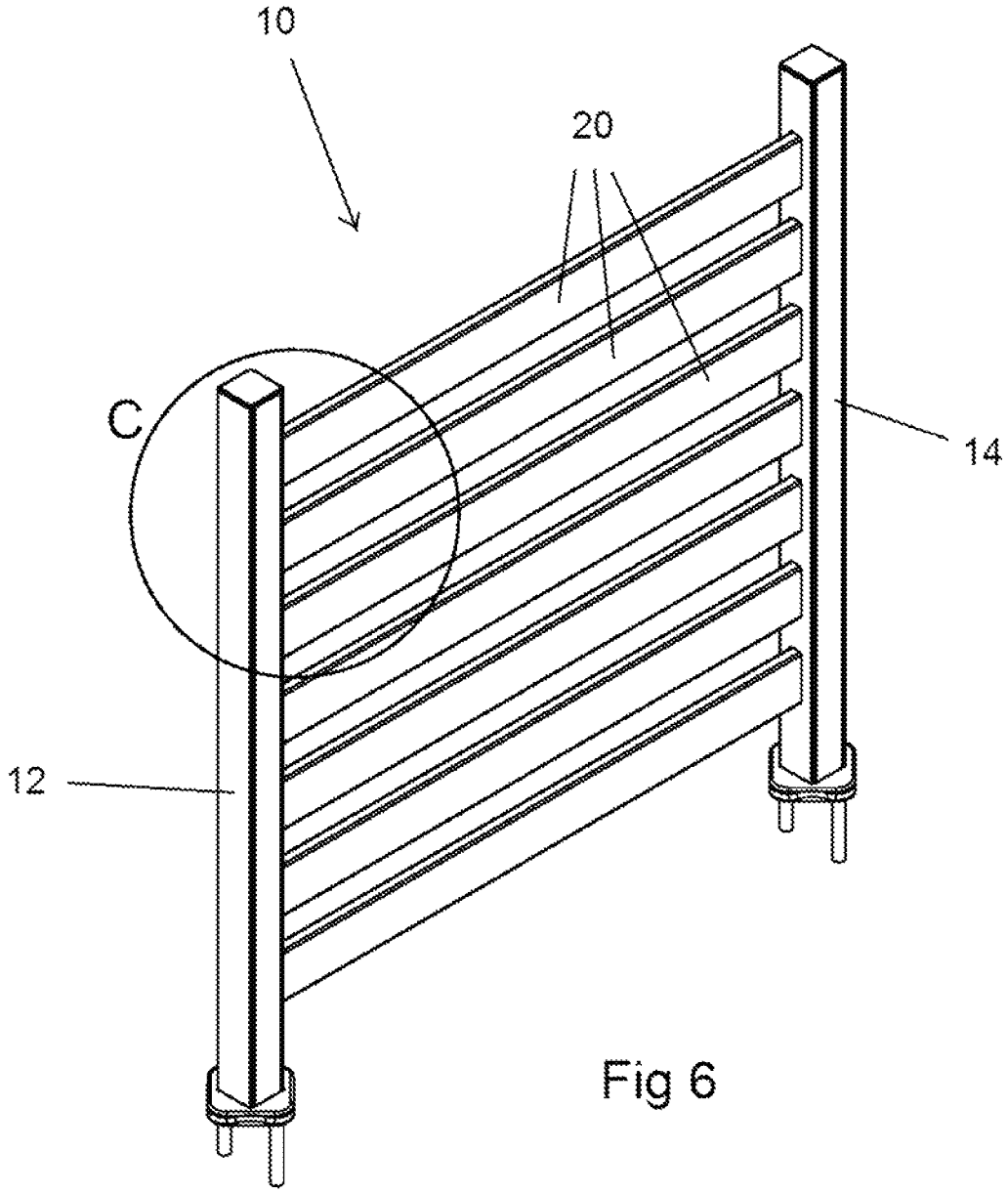
FIG. 6 is a top, perspective-view of a fence panel having first and second rails according to principles of the present invention.
Figure 7:
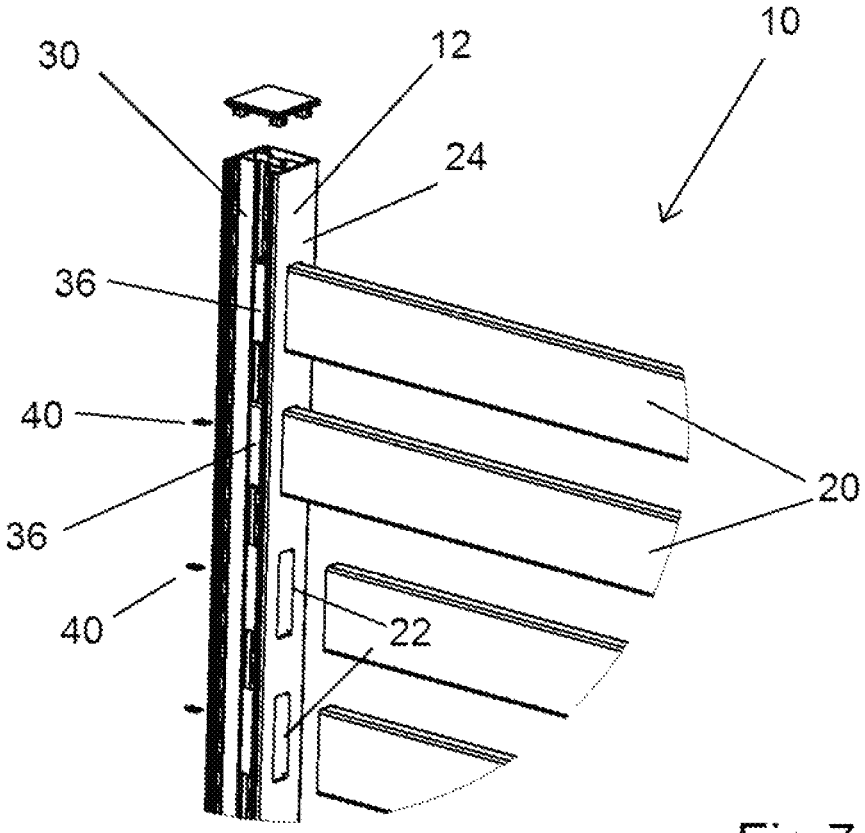
FIG. 7 is a perspective-view of Detail C of FIG. 6 with the side cover plates of the rails removed according to principles of the present invention.

As shown in FIG. 2, the first and second rails 12 and 14 are each of generally rectangular cross section. The first and second rails 12 and 14 each include a second side 26 and a third side 27 each extending perpendicularly to the first side 24. A fourth side 28 is oriented parallel to and opposite the first side 24.

Figure 8B:
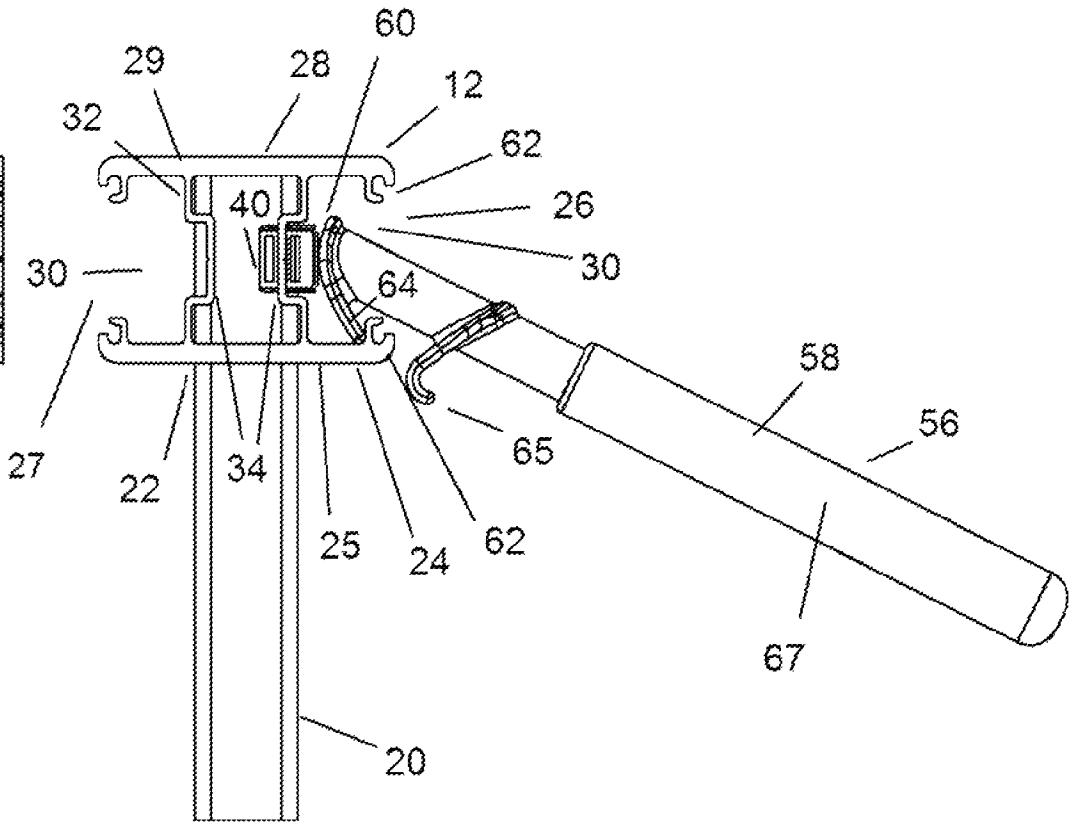
FIG. 8*b* is a side, cross-sectional view illustration showing insertion of the wedge member into the first rail according to principles of the present invention.
Figure 8A:
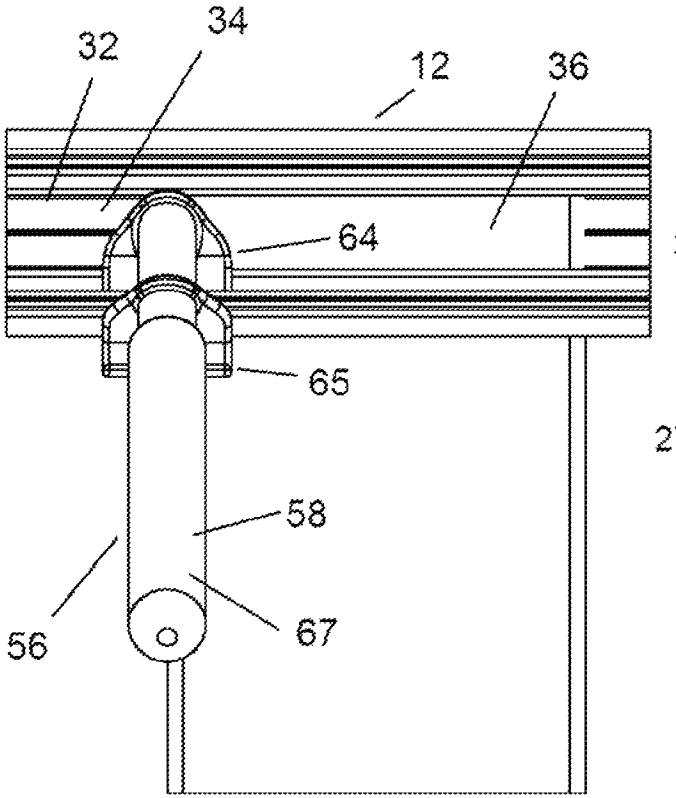
FIG. 8*a* is a front-view illustration of a wedge member into the first rail of the fence panel according to principles of the present invention.
Figure 9B:
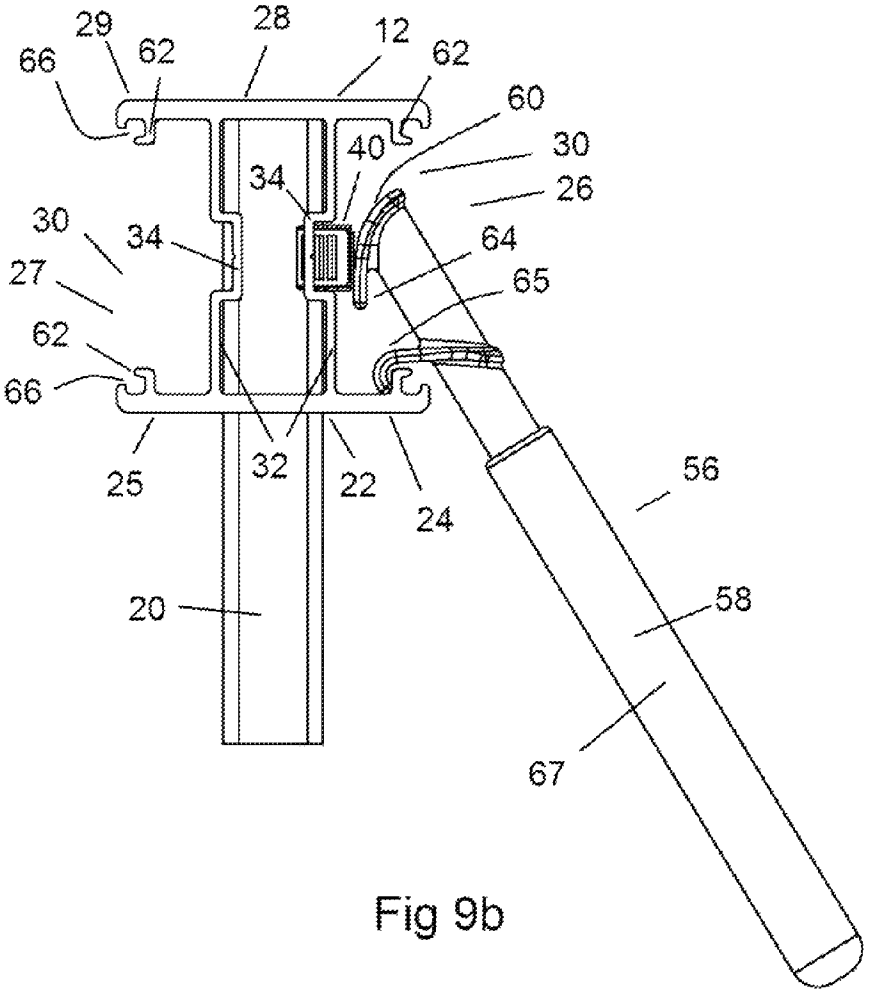
FIG. 9*b* is a side, cross-sectional view illustration showing insertion of the wedge member into the first rail of FIG. 9*a* according to principles of the present invention.
Figure 9A:
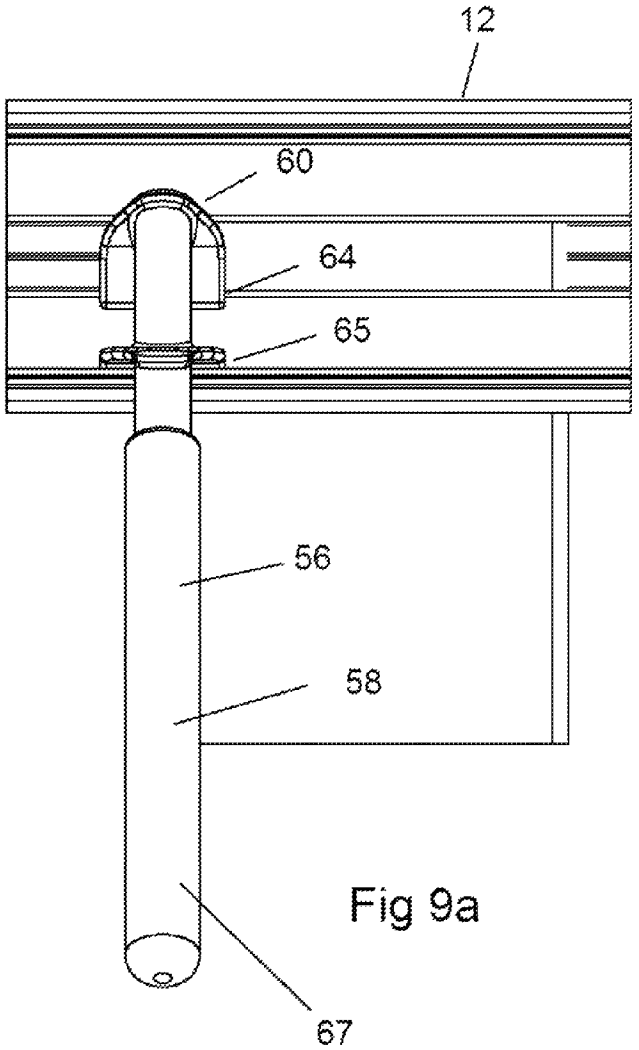
FIG. 9*a* is a front-view illustration showing insertion of a wedge member into a first rail having a greater height according to principles of the present invention.
Figure 10B:
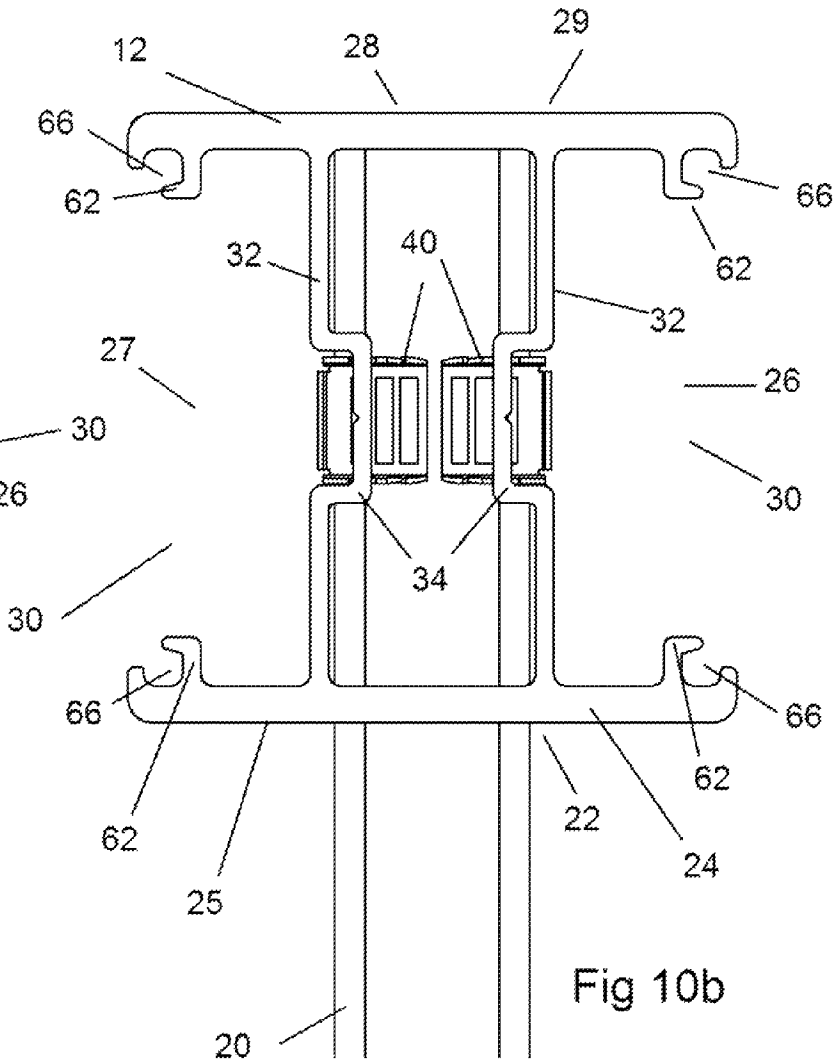
FIG. 10*b* is a side, cross-sectional view showing a pair of wedge members inserted into the rail of FIG. 9 according to principles of the present invention.
Figure 10A:
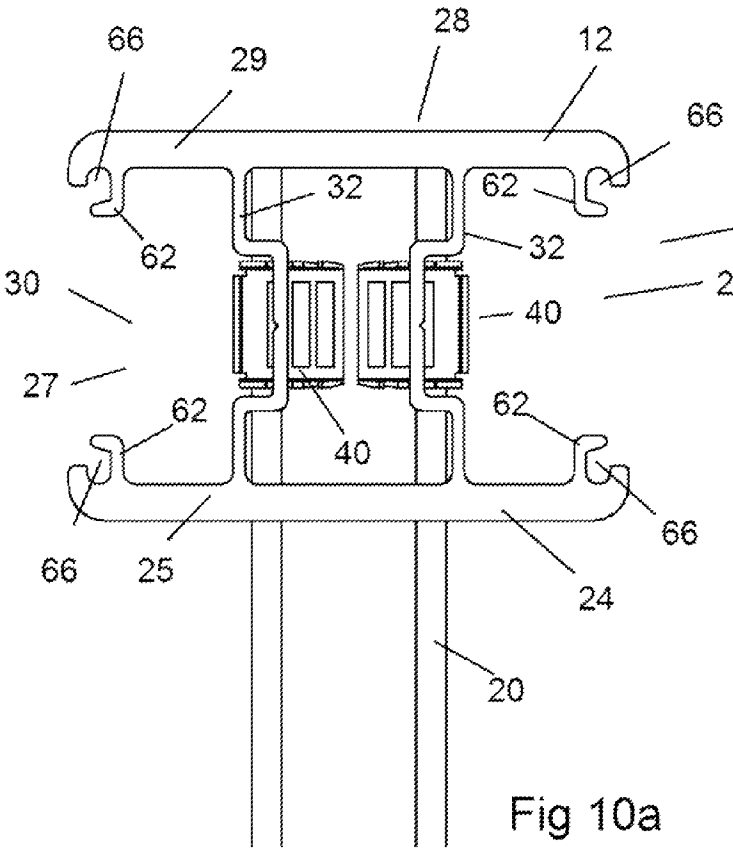
FIG. 10*a* is a side, cross-sectional view illustration showing a pair of wedge members inserted into the rail of FIG. 8 according to principles of the present invention.

Each of the first and second rails 12 and 14 is formed by a pair of parallel side walls 25 and 29 (as best seen in FIGS. 8 to 10), being located at the first and fourth sides 24 and 28 of the rail 12 and 14. The side walls 25 and 29 are interconnected by a pair of inner walls 32 such that longitudinal channels 30 are defined along the second and third sides 26 and 27 of the rails 12 and 14. In transverse cross section, the rails 12 and 14 are, therefore, generally of an H-shape (as can be seen in FIGS. 8*b* and 9*b*). The inner walls 32 also each include a recessed portion 34 along the length thereof. The recessed portions 34 are generally of rectangular transverse cross section and are located centrally on the inner walls 32. The distance between the recessed portions 34 of each inner wall 32 is less than the width of the elongate members 20.

The distance between the inner wall 32 on the first side 26 of the rail 12 or 14 and the inner wall 32 on the third side 27 of the rail 12 or 14 is such that an end of the one of the elongate members 20 can be received between the inner walls 32 (as shown in FIGS. 8*b* and 9*b*).

As shown in FIG. 2, the first and second sides 26 and 27 of the rails 12 and 14 each include a plurality of second openings 36. The second openings 36 are each associated with one of the first openings 22. Each of the second openings 36 is formed during creation of the associated first opening 22.

When the first opening 22 is cut through from the first side 24 to receive an end of an elongate member 20, the recessed portions 34 of the inner walls 32 are also cut away, leaving the second openings 36 in the recessed portions 34 of each of the inner walls 32. When one of the elongate members 20 is inserted into a first opening 22, a side of the elongate member 20 is accessible through the corresponding second opening 36 in the inner walls 32.

The fencing panel 10 is provided with a plurality of wedge members 40 and a tool 56 for inserting the wedge member 40 into the second openings 36. Each wedge member 40 includes a first side 42 and a second side 43. Each wedge member 40 is to be inserted into one of the second openings 36 between the elongate member 20 and an edge of the second opening 36 such that the first side 42 thereof engages with the elongate member 20 and the second side 32 engages with the edge of the second opening 36.

The wedge member 40 includes a relatively thin first end 44 and a relatively thick second end 45. The relatively thin first end 44 is to be inserted into the second opening 36 first such that as the wedge member 40 is pushed into the second opening 36, the wedge member 40 is wedged between the elongate member 40 and the edge of the second opening 36.

The wedge member 40 in the embodiment shown comprises a relatively planar body 46 having a transverse edge portion 48 adjacent the second end 45 thereof. Tapered edge portions 50 are provided along opposed edges of the planar body 46 extending from the first end 44 to the second end 45. The tapered edge portions 50 tapered outwardly from the first end 44 to the second end 45 to provide the wedge shape.

The first side 42 of the wedge member 40 includes a plurality of ribs 52 thereon. The ribs 52 extend perpendicularly to the direction of travel of the wedge member 40 as it is inserted into the second opening 36 such that the ribs 52 engage and grip against the side of the elongate member 20. The distal edges of the tapered edge portions 50 also include triangular serrations 54 to engage against the edge of the second opening 36 as the wedge member 40 is pressed into place.

The tool 56 is provided for levering the wedge members 40 into the second openings 36. The tool 56 comprises an elongate shaft 58 having an engagement surface 60 adjacent a first end thereof. A handle grip 67 is provided adjacent an opposite second end thereof.

The channels 30 provided in the second and third sides 26 and 27 of the rails 12 and 14 are each provided with lip portions 62 adjacent the outer edges thereof. The lip portions 62 extend inwardly into the channel 30 along each end of the side walls 25 and 29 (as best seen in FIGS. 8*b* and 9*b*). The tool 60 includes at least one arm portion extending outwardly from the shaft 58 adjacent the first end thereof. In the embodiment shown, there is provided a first arm portion 64 at the first end of the shaft 58 and a second arm portion 65 extending outwardly from the shaft 58 at a location offset from the first end.

Distal ends of the arm portions 64 and 65 are provided to engage in the channels 30 against an inner side of the lip portion 62. When the distal end of the arm portion 64 or 65 engages against the inner side of the lip portion 62 the engagement surface 60 is generally adjacent the second end 45 of the wedge member 40. By moving the tool 56 such that the tool 56 pivots about the distal end of the arm portion 64 or 65, the engagement surface 60 presses against the wedge member 40. This levering action allows sufficient force to be applied in order to push the wedge member 40 into place between the elongate member 20 and the edge of the second opening 36. The ribs 52 and serrations 54 act to hold the wedge member in place and secure the elongate member 20 to the rail 12 or 14.

The use of multiple arm portions 64 and 65 allows for different dimensioned rails 12 and 14. As can be seen in FIG. 9, the second arm portion 65 is provided to allow the tool 56 to work on a rail 12 in which the distance between the opposed side walls 25 and 29 is greater than that shown in FIG. 8.

As can be seen in FIG. 10, wedge members 40 may be inserted into the second openings 36 from both the second and third sides 26 and 27 to secure the elongate members 20.

The lip portions 62 of the side walls 25 and 29 also define longitudinal slots 66 along the edges of the side walls 25 and 29. These slots 66 receive complementary ribs provided on side cover plates 68. The side cover plates 68 are press fit across the channels 30 to provide a finished appearance to the first and second rails 12 and 14.

It will be readily apparent to persons skilled in the relevant arts that various modifications and improvements may be made to the foregoing embodiments, in addition to those already described, without departing from the basic inventive concepts of the present invention.

What is claimed is:

1. A fencing panel comprising:

a first rail having a first side wall, a second side wall perpendicular to the first side wall, a third side wall opposite and parallel to the second side wall, and a fourth side wall opposite and parallel to the first side wall;

a plurality of first openings in the first side wall of the first rail;

a plurality of elongated picket members provided such that a first end of each of the elongated picket members is received in one of the first openings;

a first longitudinal channel provided along the second side wall of the first rail;

a first recessed portion along the length of an inner wall of the first longitudinal channel;

a plurality of second openings provided within the first longitudinal channel, each of the second openings corresponding to one of the first openings and being formed by cut away sections of the first recessed portions such that opposed sides of an elongated picket member received within the first opening are engaged by edges of the second opening;

a plurality of wedge members; and a first side cover plate securable across the first longitudinal channel;

wherein one of the wedge members is inserted into each of the second openings such that the wedge member engages with the edge of the second opening and one of the sides of the elongated picket member inserted into the corresponding first opening, such that the elongated picket member is secured to the first rail.

2. The fencing panel as set forth in claim 1, wherein the first rail comprises a second longitudinal channel provided along the third side wall thereof, a second recessed portion along the length of an inner wall of the second longitudinal channel, and a second side cover plate securable across the second longitudinal channel.

3. The fencing panel as set forth in claim 2, wherein the first and second side walls comprise a pair of parallel side portions interconnected by a pair of the inner walls defining the longitudinal channels along the second and third side walls of the first rail.

4. The fencing panel as set forth in claim 3, wherein the distance between the recessed portions of each inner wall is less than the width of the elongated picket members.

5. The fencing panel as set forth in claim 4, wherein the recessed portions are generally of rectangular transverse cross section and are located centrally on the inner walls.

6. The fencing panel as set forth in claim 5, wherein each wedge member is to be inserted into one of the second openings between the elongated picket member and the edge of the second opening such that a first side thereof engages with the elongated picket member and a second side engages with the edge of the second opening.

7. The fencing panel as set forth in claim 6, wherein the wedge member comprises a first end and a second end such that the first end is to be inserted into the second opening first, such that as the wedge member is pushed into the second opening, the wedge member is wedged between the elongated picket member and the edge of the second opening, wherein the first end of the wedge member is thin relative to the second end of the wedge member.

8. The fencing panel as set forth in claim 7, wherein the first side of the wedge member comprises a plurality of ribs extending perpendicularly to the direction of travel of the wedge member as it is inserted into the second opening such that the ribs engage and grip against the side of the elongated picket member.

9. The fencing panel as set forth in claim 8, wherein the wedge member comprises triangular serrations on a second side thereof to engage against the edge of the second opening as the wedge member is pressed into place.

10. The fencing panel as set forth in claim 7, wherein the wedge member comprises a planar body having a transverse edge portion adjacent the second end thereof and tapered edge portions along opposed edges of the planar body extending from the first end to the second end, the tapered edge portions including the triangular serrations.

11. The fencing panel as set forth in claim 10, wherein each longitudinal channel is provided with lip portions adjacent the outer edges thereof such that a tool comprising a shaft having an outwardly extending arm portion may be engaged with one of the lip portions and pivoted to engage the wedge member and push the wedge member into place.

12. The fencing panel as set forth in claim 11, wherein the lip portions define longitudinal slots along edges of the side walls to receive complementary shaped ribs provided on the side cover plate.

13. The fencing panel as set forth in claim 1, wherein there is provided a second rail having a plurality of openings on a first side thereof to receive second ends of the elongated picket members.

14. The fencing panel as set forth in claim 13, wherein the first and second rails are connected at first ends thereof to a first post member and at second ends thereof to a second post member.

* * * * *